US007246918B2

(12) United States Patent
Ginsburg

(10) Patent No.: US 7,246,918 B2
(45) Date of Patent: Jul. 24, 2007

(54) LARGE AREA LIGHTING SYSTEM

(75) Inventor: Thomas A. Ginsburg, Highland Park, TX (US)

(73) Assignee: CHM Industries, Inc., Saginaw, TX (US)

( * ) Notice: Subject to any disclaimer, the term of this patent is extended or adjusted under 35 U.S.C. 154(b) by 0 days.

(21) Appl. No.: 10/908,371

(22) Filed: May 9, 2005

(65) Prior Publication Data

US 2006/0250804 A1 Nov. 9, 2006

(51) Int. Cl.
*F21V 21/14* (2006.01)

(52) U.S. Cl. ..... 362/250; 362/230; 362/145; 362/279

(58) Field of Classification Search ..... 362/250, 362/147, 145, 279, 290, 342, 382
See application file for complete search history.

(56) References Cited

U.S. PATENT DOCUMENTS 4,237,530 A 12/1980 Murray et al.
4,851,980 A 7/1989 McWilliams et al.
4,866,582 A 9/1989 Osteen et al.
5,077,649 A * 12/1991 Jackel et al. ..... 362/325
5,586,015 A * 12/1996 Baldwin et al. ..... 362/263
5,647,152 A * 7/1997 Miura ..... 40/541
5,730,521 A 3/1998 Spink et al.
5,975,726 A 11/1999 Latimer
6,074,075 A 6/2000 Staniec
6,155,696 A * 12/2000 Winton et al. ..... 362/250
6,303,857 B1 10/2001 Ginsburg
2001/0035293 A1 11/2001 Ginsburg
2004/0037084 A1 2/2004 Ginsburg

* cited by examiner

*Primary Examiner*—Renee Luebke
*Assistant Examiner*—Evan Dzierzynski
(74) *Attorney, Agent, or Firm*—Gardere Wynne Sewell LLP

(57) ABSTRACT

A large area lighting system, adapted for high mast highway or stadium lighting, for example, includes one or more elongated frames supporting plural light fixtures and elongated light baffles comprising respective sets of spaced apart slats. The respective sets of slats are supported on elongated rods connected to light fixture frame members and the slats are separated by spacers sleeved over the rods. The slats may be oriented at various angles by manual or motor driven adjustment to control the light projection from the lighting system. The slats may also be non-reflective or provided with a mirrored finish to effect control of light projection and/or diffusion.

8 Claims, 10 Drawing Sheets

LARGE AREA LIGHTING SYSTEM

BACKGROUND

The present invention relates to the general field of lighting systems, and in particular, to large area lighting systems.

Large area lighting systems provide various levels of illumination for a variety of applications while minimizing ground level obstructions. Large area lighting systems are often used to illuminate large areas such as highways and stadiums. In densely populated areas, such large area lighting systems tend to "spill" light into nearby residential areas and thus create a nuisance for the residents. Light spillage also contributes to other problems, such as increased light pollution and sky glow. As a result, many jurisdictions have enacted laws preventing the installation of large area lighting systems in close proximity to residential areas.

There have been several unsuccessful attempts by those skilled in the art to address the light spillage issues referenced above. For example, prior art efforts have addressed light spillage problems by placing shields directly on individual lighting fixtures, see for example FIG. 1. These shields, later described in detail herein, partially restrict light from being transmitted in a particular direction, but do not efficiently or effectively eliminate the majority of unwanted light spillage. Thus, the light cut-off from such lighting fixtures is insufficient and fails to prevent light spillage from infiltrating, for example, any adjacent residential areas. Prior art shields also fail to address the issue of controlling light spillage from a combination of fixtures and thus are an inadequate solution to the problem. Moreover, prior art light shields have significant wind resistance or wind loading problems. In fact, because many prior art shields or baffles may act like a "sail" over the light pole, they create hazardous and unsafe conditions, often compromising the structural integrity of large area lighting poles and ultimately jeopardizing the safety of any potential bystanders. The effective projected area (EPA) of the structure, which generally describes the area of a given lighting unit affected by the wind, is typically and undesirably high in prior art shielded large area lighting systems. Thus, existing systems require stronger and more expensive light poles and structures to withstand the high wind loading.

Others have addressed the light spillage problem by placing shields inside the lighting fixtures. For example, some prior art luminaires are fitted with internal shields which supposedly control the emission of light only at certain specified angles. Although internal shields generally assist in directing light in a particular direction and help reduce some glare, internal shields fail to control light spillage adequately, and are not adjustable to control the amount of spillage. Internally shielded fixtures have large cut-offs and thus complicate the photometrics used in designing lighting systems. Moreover, fixtures outfitted with internal shields generally increase the expense of lighting fixtures. These fixtures often times deteriorate the light quality provided at the subject location and ultimately focus the light as a spotlight rather than an area light. Light fixtures with internal cut-off shields thus defeat the purpose of large area lighting systems.

Others in the art have fitted various types of external shields onto lighting fixtures. Although some external shields appear to provide adequate cut-off levels, they are often bulky and need to be excessively large to provide acceptable cut-off levels. Thus, prior art externally shielded lighting systems may have high EPA levels and project light similar to that found in spotlights. Thus, fitting lighting fixtures with such external shields reduces the effective and desired lighting area dramatically.

Accordingly, there is a continuing need for an effective and efficient lighting system to provide sufficient light to large areas, such as highways, while eliminating light spillage into adjacent areas, such as residential neighborhoods. What is also needed is a large area lighting system which reduces light pollution and sky glow. What is further needed is a system of maintaining area lighting capabilities at a subject site while achieving very low cut-off. What is still further needed is a system to provide effective light shielding to a plurality of light fixtures while maintaining a reduced EPA level.

SUMMARY OF THE INVENTION

The present invention provides an improved large area lighting system. In a preferred embodiment light spillage is minimized or eliminated for an entire lighting unit, rather than just individual fixtures. The improved lighting system provides a light baffle designed to block light spillage from the entire light fixture and maintains a very low effective projected area (EPA) level.

In accordance with an important aspect of the invention, a 'slat' style light baffle is provided. The slats are preferably positioned to extend horizontally, thus providing, for example, the best combination of sufficient light delivery, effective light shielding and low EPA. One preferred embodiment provides, for example, a light baffle which may be adjusted in different orientations to increase light delivery to a subject lighting area while minimizing light spillage into a protected area, decreasing light pollution, eliminating unnecessary sky glow and maintaining a low EPA. The orientation of the slat type baffles allows light to selectively pass through or be diffused by the light baffle to the subject lighting area. Conversely, unwanted light cannot directly pass between the light baffle to the protected area, such as a residential area.

In accordance with another aspect of the invention, a preferred embodiment is fully customizable and may be retrofitted into existing lighting systems. Different lengths of slats may be provided to increase light delivery to the subject lighting area or, for example, decrease or eliminate light delivery to the protected area. Slats may be easily exchanged, added on to or removed from the light baffle. In addition, a preferred embodiment may be configured to remotely orient the slats for accurate on-site installation or for routine maintenance as desired. The light baffle of the invention is virtually maintenance free and minimizes the lighting system's overall wind resistance. Thus, the preferred embodiments exhibit a very low EPA level. To further minimize indirect light spillage and enhance lighting capabilities, the slats may be subjected to different surface treatments. For example, the slats may be anodized to provide a flat black surface to lower the reflectivity of the surface. The slats may also be treated with a mirror finish in applications requiring enhanced lighting, such as in stadium lighting.

Still further, a preferred embodiment of the invention provides a large area lighting system comprising a light source and one or more slats configured to control light emitting from the one or more light sources. The large area lighting system may have a plurality of adjustable light sources arranged in various configurations including one or more rectangular rows, one or more circular configurations, one or more semi-circular configurations, one or more arched configurations, one or more staggered formations, and combinations thereof. The slats may be optionally treated to provide a flat black or a mirrored finish depending on the application. Preferably the light baffle slats may be configured to minimize sky glare or glow, the effective projected area and light delivery to a protected area. The light baffle may include a rigid link extending between sets of slats; axles supporting each of the slats; a motor configured to move the rigid link and a remote control configured to control the orientation of the slats.

DETAILED DESCRIPTION OF THE PREFERRED EMBODIMENTS

While the construction and use of preferred embodiments is discussed in detail below, it will be appreciated that the specific embodiments described do not limit the scope of the invention.

Figure 1:
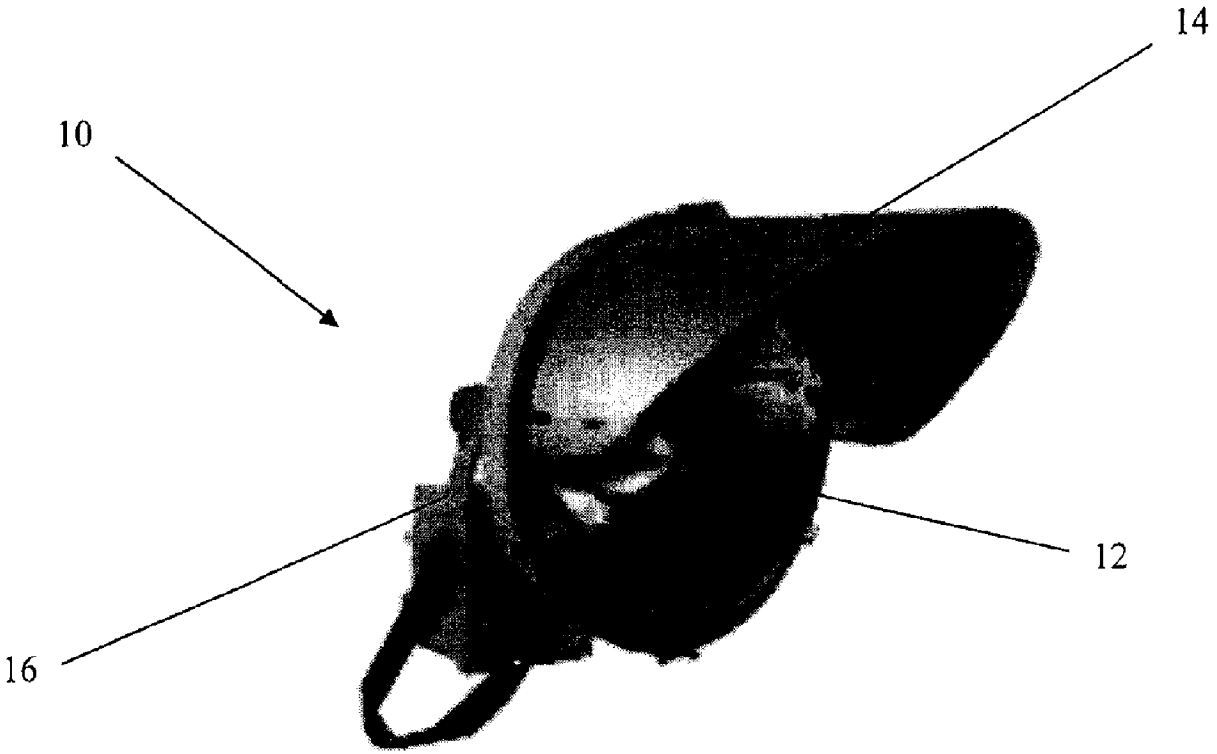
PRIOR ART FIGURE 1
FIG. 1 is a perspective view of a large area lighting fixture of the prior art.

As mentioned earlier, large area lighting systems known in the art "spill" light into protected areas such as residential areas. For example, prior art lighting systems, such as lighting system 10, depicted in FIG. 1, fail to protect areas from unwanted light trespass. Lighting system 10 generally includes a lighting fixture 12, a shield 14 and a light base 16. Although the concept is widely adopted in the art, shield 14 fails to prevent light from "spilling" into protected areas. Often times, lighting system 10 and other large area lighting systems known in the art increase the overall effective projected area (EPA) of the structure of the system. Thus, existing systems often require, for example, stronger, more expensive poles and other support structures to accommodate higher EPAs. Lighting system 10 and other large area lighting systems known in the art thus fail to withstand wind loading effects effectively or provide other benefits of the present invention.

A preferred embodiment of the present invention addresses the numerous deficiencies found in prior art lighting systems and provides further advantages. Preferably, a large area lighting system 18, FIGS. 2 and 3, when employed in a highway type setting, for example, not only provides adequate lighting to the highway, but is designed to minimize or even eliminate light spillage to outlying residential areas while also minimizing EPA. Thus, large area lighting system 18, in accordance with a preferred embodiment as shown in FIGS. 2 and 3, directs light to the intended lighting area without spilling light into protected areas, such as residential areas.

Lighting system 18 shown is adapted for a high mast type support and is shown supported on and is compatible with a high mast type pole 20. However, system 18 may, for example, be supported on simple industrial and street lighting columns, other high mast structures, hydraulic-based hinged columns and poles with top or bottom latching lifting mechanisms. In the example depicted in, FIGS. 2 and 3, a ring assembly 22 is operably connected to a high mast head frame and dome cover assembly 24 by spaced apart depending cables 25, FIG. 2, to support the large area lighting system 18 on and with respect to the pole 20 in a conventional manner. Other support structures, in lieu of or in combination with the ring assembly 22, may be employed to support the large area lighting system 18 with respect to the pole 20 or similar support structure.

Figure 2:
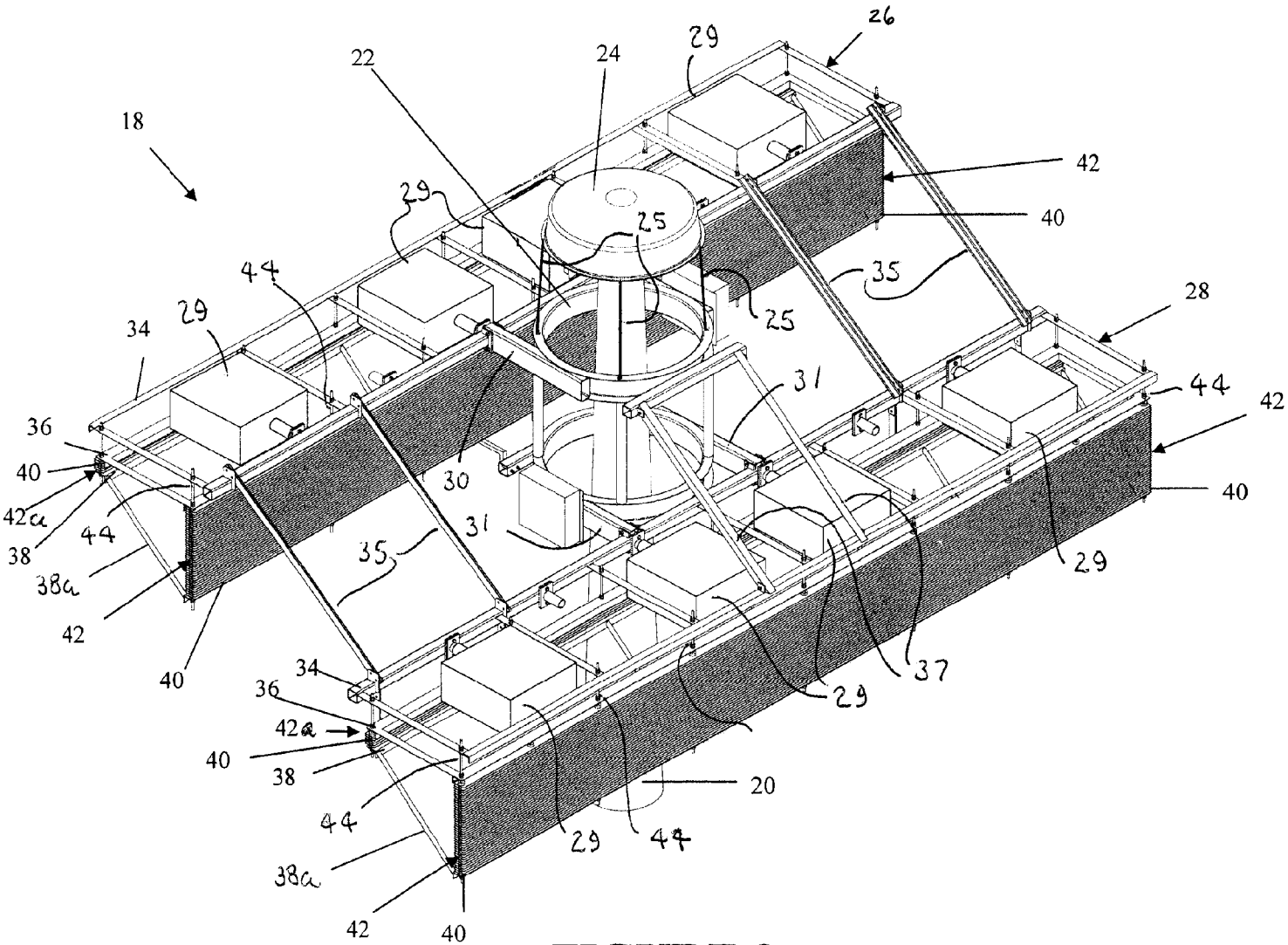
FIG. 2 is a perspective view of a preferred embodiment of a large area light system.
Figure 3:
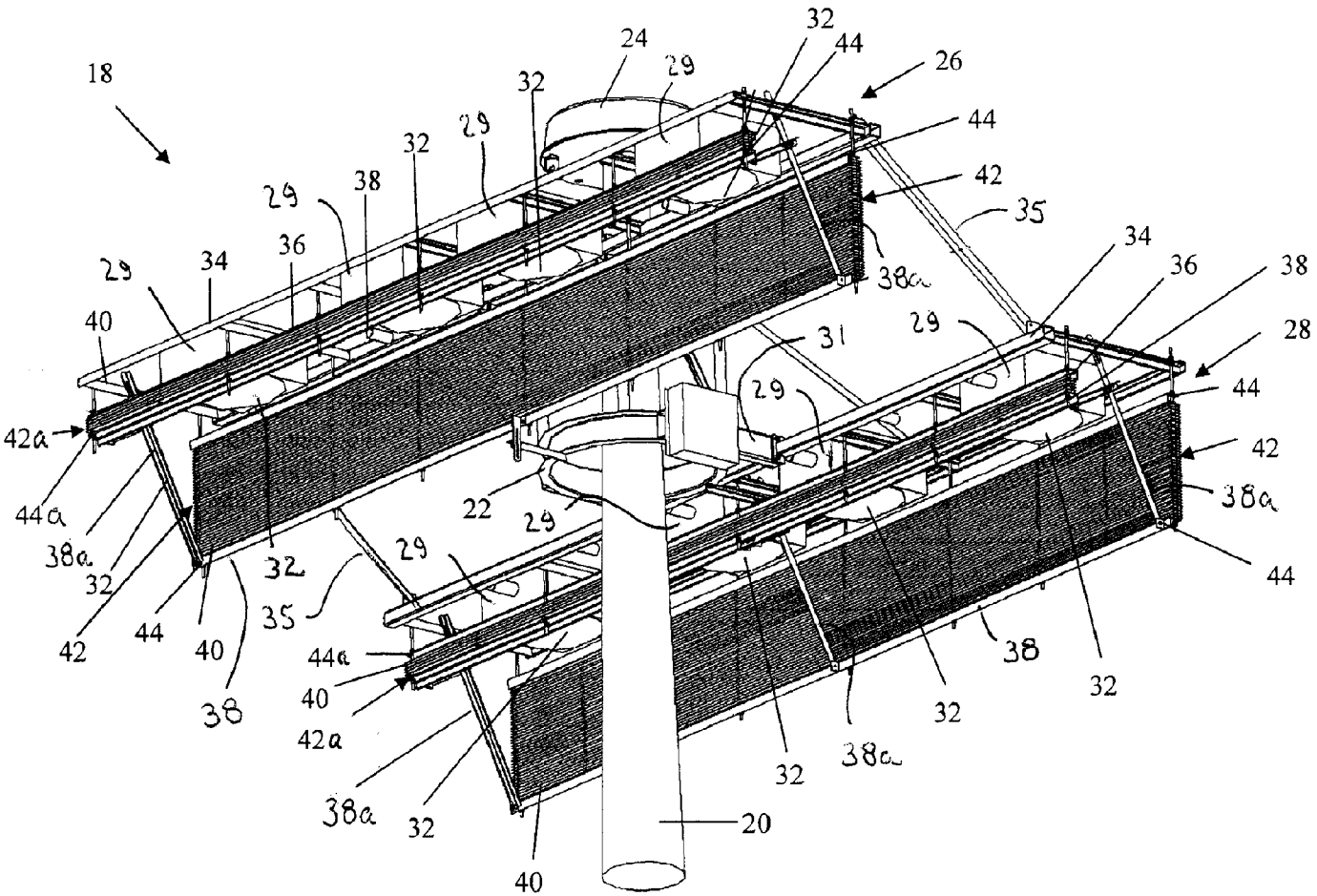
FIG. 3 is another perspective view of the large area lighting system shown in FIG. 1.

Lighting system 18, as shown in FIGS. 2 and 3, includes two rectangular rows of lighting fixtures, a so-called subject-side row of fixtures 26 and a back-side row of fixtures 28. Continuing with the highway example given earlier, the subject side row of fixtures 26 is the row of fixtures in closest proximity to the highway, while the back-side row of fixtures 28 is the row of fixtures furthest from the highway. Rows 26 and 28 each include four spaced apart lamp fixtures or enclosures 29, as shown by way of example. The fixture rows (26, 28) may be, for example, configured in vertically staggered rows, as depicted in FIGS. 2 and 3, or in a circular configuration (not depicted), a semi-circle configuration (not depicted), in an arched configuration (not depicted) or any combination thereof. It should be understood, however, that any number of or shapes of fixtures may be employed depending on the particular application desired and type of light delivery required by the subject lighting area and the degree of light shielding required by the protected area.

Figure 4:
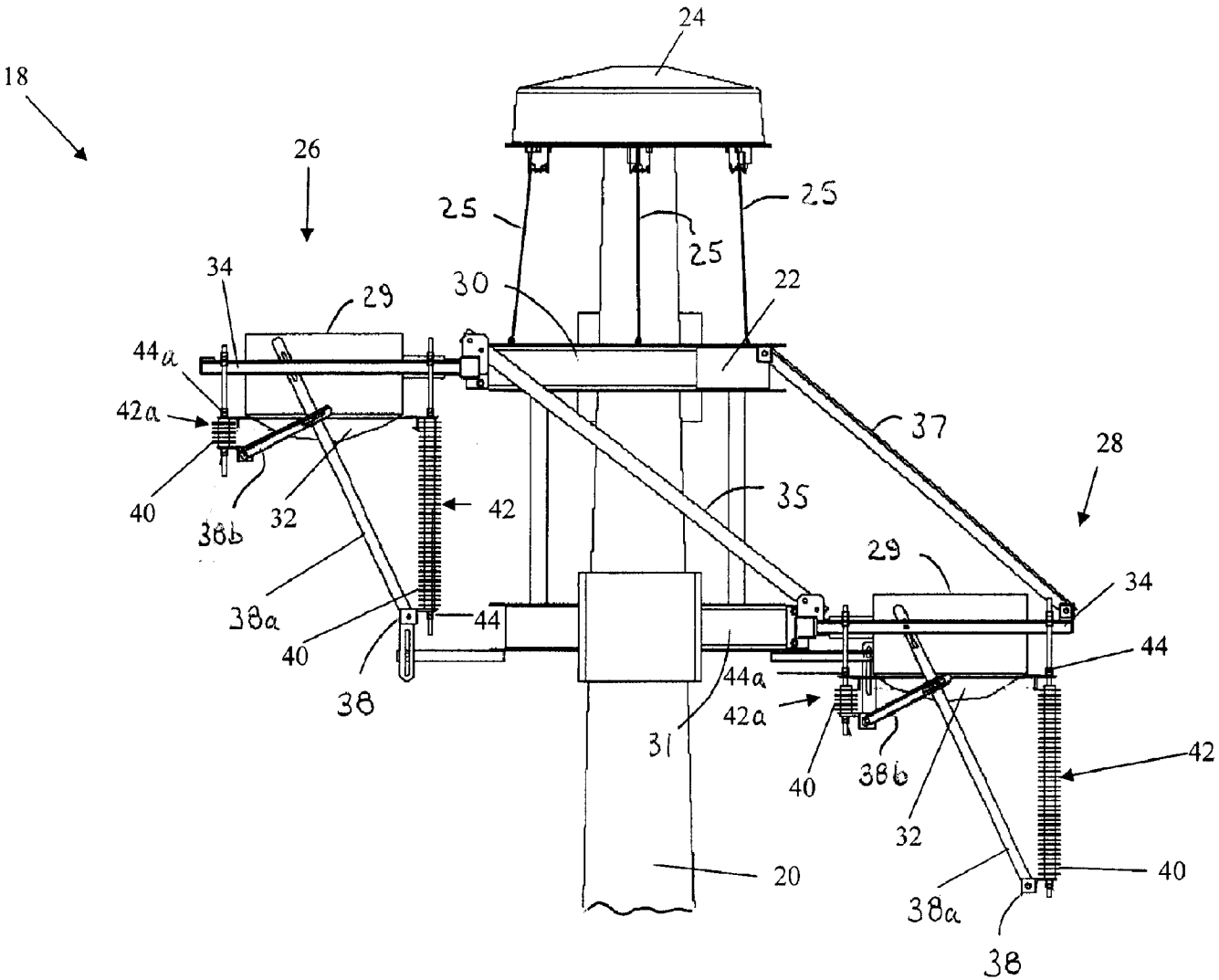
FIG. 4 is a side elevation of a preferred embodiment of a large area lighting system.

Referring now to FIG. 4, the subject-side row of fixtures 26 is supported slightly elevated vertically when compared to the back-side row of fixtures 28. This graduated configuration off-sets the relative positional heights of the two rows of fixtures (26, 28) to provide optimum lighting to the subject lighting area. Again, continuing with the highway example, the fixtures 29 shown in FIGS. 2 and 3, may be configured into two rectangular rows of fixtures (26, 28) where subject-side row of fixtures 26 closest to the highway is offset vertically from the back-side row of fixtures 28. In other applications, the relative positions of the fixtures 29 may be adjusted to accommodate specific design specifications. The preferred large area lighting system 18 may use eight fixtures 29, each supporting one or more lamps 32, as shown in FIG. 3.

The rows of fixture 26 and 28 include frames characterized by spaced apart rectangular so-called ladder type rack assemblies 34 mounted, respectively, on ring assembly 22 at respective brackets 30 and 31, FIG. 2. Upper racks 34 are also braced by respective braces 35 and 37 as shown, FIG. 2. The fixtures 29 of each row 26 and 28 are supported on the respective upper rack assemblies 34, as shown in FIGS. 2, 3 and 4.

Referring further to FIGS. 2, 3 and 4, respective sets of spaced apart slats 40 are supported by and between a rectangular ladder type middle rack assembly 36 and a lower rack assembly 38 of the aforementioned frames to form light baffles 42 and 42*a* for each row 26 and 28. The slats 40 are disposed on spaced apart elongated depending threaded support rods 44 and 44*a*, as seen also in FIG. 5. Each slat 40 is preferably separated from an adjacent slat by a spacer 45, thus providing a slot or wind flow path between each slat. At least selected ones of support rods 44 and 44*a* extend to and are connected to rack assemblies 34, 36 and 38 and are secured thereto by conventional nut type fasteners, FIG. 5. Accordingly, the light baffles 42 and 42*a* do not increase wind resistance or suffer detrimental wind loading effects in large area lighting system 18 while preferably being configured to direct and shield light from one or more arrays or rows of lighting fixtures (e.g., 26 or 28) in a desired manner. A preferred embodiment thus comprises slat style shield or light baffles 42 and 42*a* which minimizes EPA while exhibiting adequate shielding required by virtually any application.

Figure 5:
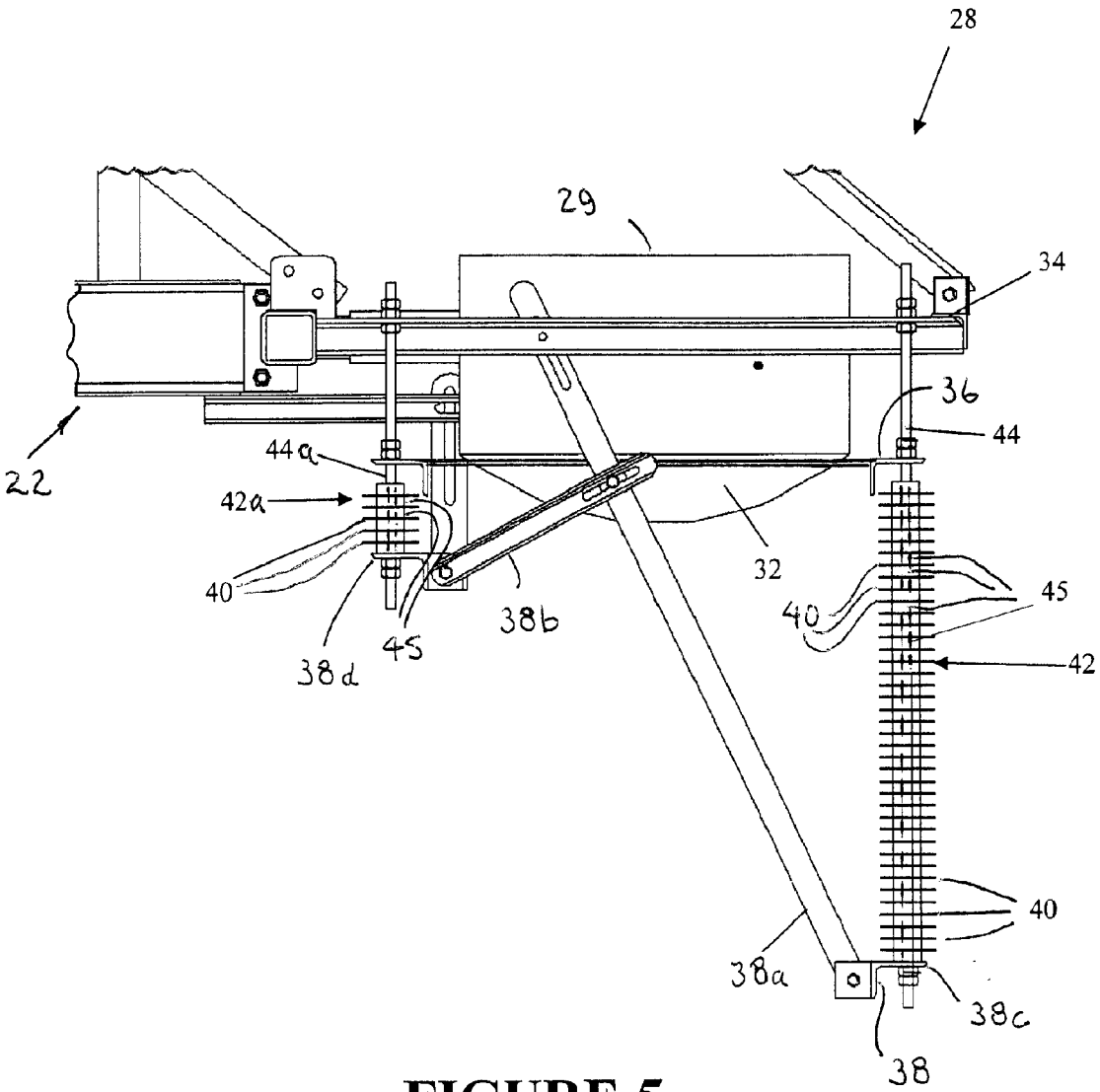
FIG. 5 is a detail elevation view of a portion of the large area lighting system shown in FIG. 4 on a larger scale.

The number and length of the slats 40 can easily be changed to accommodate the desired lighting. Each slat 40 is preferably oriented to achieve the desired illumination of a subject lighting area while shielding light from the protected area and minimizing EPA. For example, the back-side row of fixtures 28 may be oriented to reduce the light escaping from its light baffles 42 and 42*a*. Thus, light cannot physically pass between the lamps 32 and a protected area on one side of the baffles 42 and 42*a*. This is especially important in situations such as in the highway application example, where the highway may run adjacent to residential areas. The light baffles 42 and 42*a* may be angled in such a manner to block the light and minimize a direct light path to the residential area, while still providing adequate lighting to the highway. In addition, different lengths of slats 40 may be used at different locations to increase or decrease the protection area and/or subject lighting area. The slats 40 of baffles 42 and 42*a* are preferably positioned horizontally, as shown in FIGS. 4 and 5 thus providing the best combination of light protection and low EPA. However, it should be understood that the slats 40 may be oriented in any position, for example, in a vertical or even transverse position. It should be further understood that a preferred embodiment may be configured to provide 100% or near 100% protection by shielding light from being delivered to protected areas.

Referring to FIG. 3 and particularly FIG. 5, lower rack assemblies 38 are characterized by elongated angle members 38*c* and 38*d*, FIG. 5, which are connected to rack assemblies 36, respectively by the elongated rods 44 and 44*a*. However, in order to accommodate various heights of baffles 42 and 42*a* rack members 38*c* and 38*d* may be interconnected by bracing comprising brace members 38*a* and 38*b* which are adjustable to allow for stacking slats 40 and spacers 45 in various numbers to adjust the overall height of the respective baffles 42 and 42*a*, as will be appreciated by those skilled in the art.

Figure 6A:
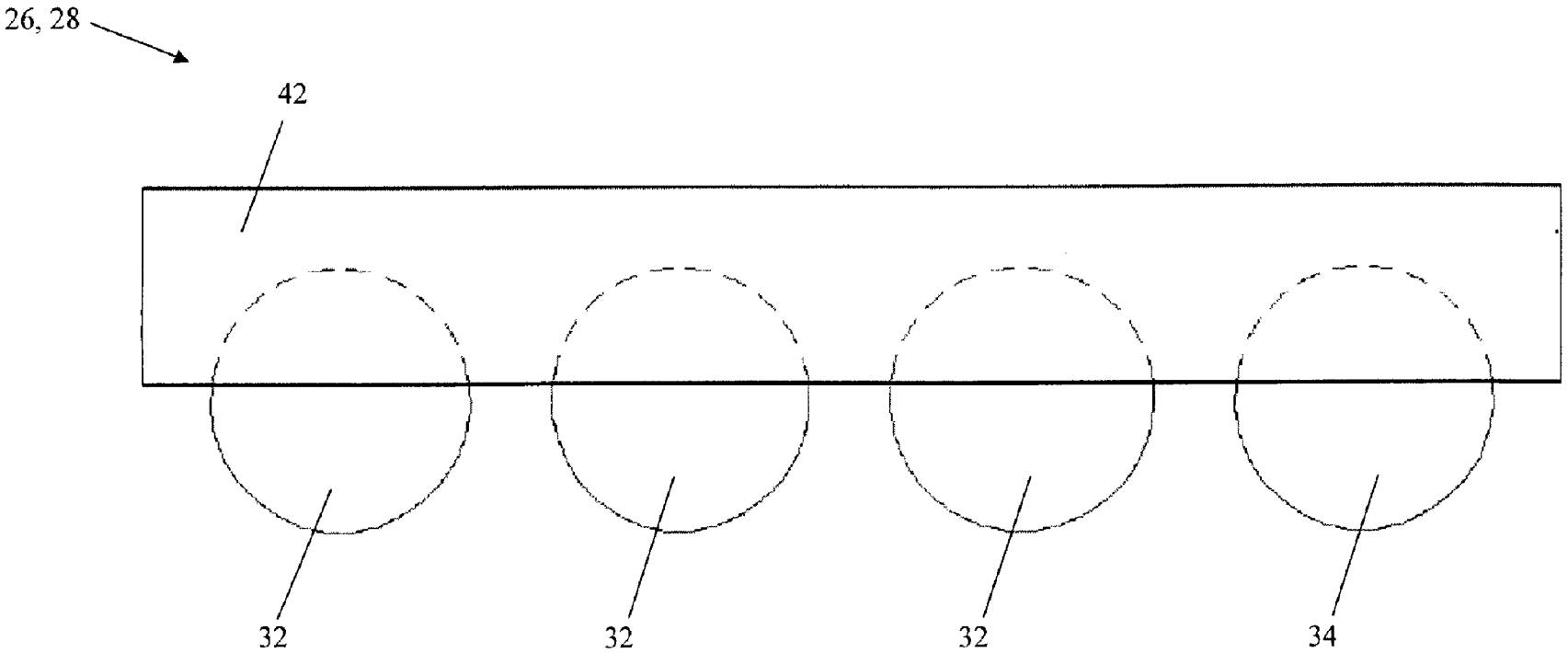
FIG. 6A is a simplified plan view of a portion of a large area lighting system in accordance with the invention.
Figure 6B:
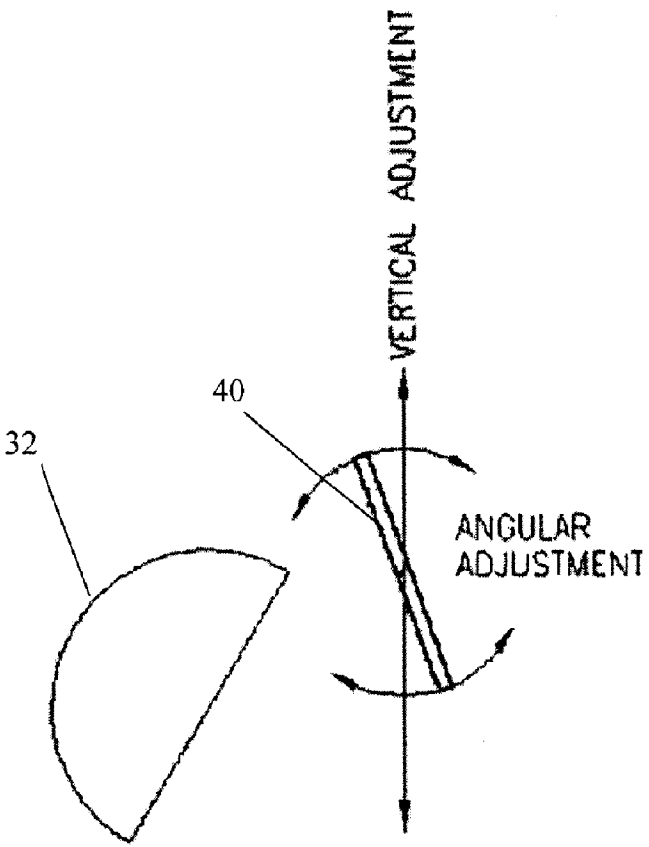
FIG. 6B is a somewhat schematic diagram showing the angular and vertical adjustment capability of the light baffle.
Figure 7B:
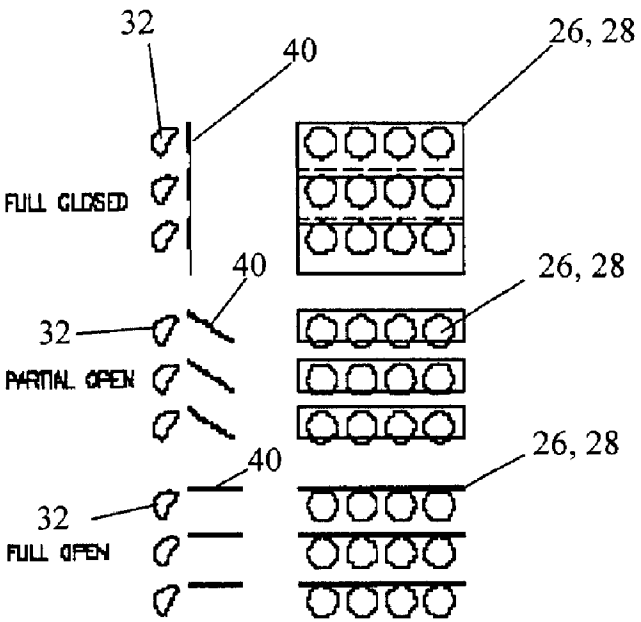
FIG. 7B is a schematic diagram showing various positions of one preferred arrangement of light fixtures and baffles in accordance with the invention.
Figure 7A:
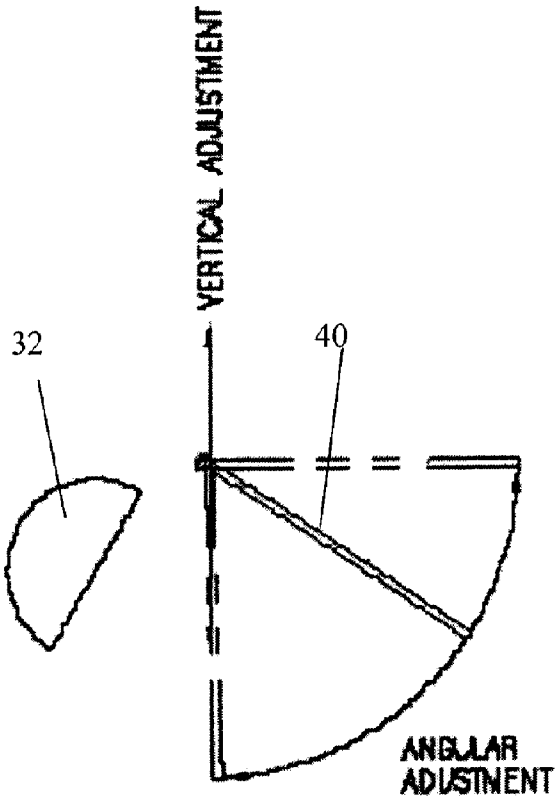
FIG. 7A is a somewhat schematic diagram also showing vertical and angular adjustment.

Now referring to FIGS. 6A and 6B, the light fixture rows 26 and 28 may be preferably configured to provide different light baffle 42 settings. For example, the slats 40 may adjust in several ways, including for example, accommodating vertical and angular adjustments. FIG. 6B illustrates the capability of both angularly and vertically adjusting the slats 40 in a full 360 degree fashion in a preferred embodiment. Alternatively, as shown in FIG. 7A, the slats 40 may be configured to adjust and accommodate vertical and angular adjustment from a fully closed position to a fully open position, as illustrated in FIG. 7B. In addition, the lanterns 32 may be configured to orient at different positions as well. Thus, in accordance with a preferred embodiment, each large area lighting system 18 can customize the lantern 32 and light baffle 42 orientation according to design specifications.

It may be important to perform the above-mentioned customizable adjustments to large area lighting system 18 remotely. For example, in the highway application example, a preferred embodiment may have the optional capability to remotely adjust the large area lighting system 18, including minimizing (and possibly eliminating) any light spillage into that residential area. These adjustments to the large area lighting system 18 may be accomplished by employing several different methods including, for example, radio-controlled mechanisms or by hardwiring controls to a ground-accessible service box (not depicted) for pole 20. It should be understood by those skilled in the art that there are a number of other methods to accomplish adjustments to the light baffle 42 and 42*a* remotely, including, for example, the aforementioned wireless remote control systems.

Figure 8B:
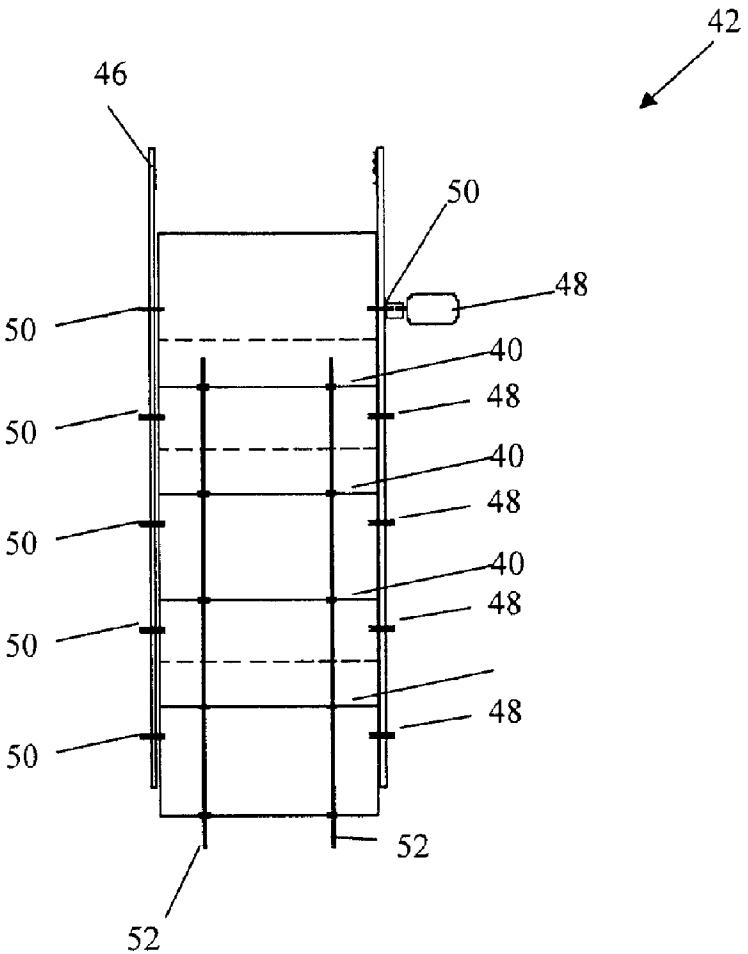
FIG. 8B is a schematic front elevation view showing the mechanism for adjusting of the slats.
Figure 8A:
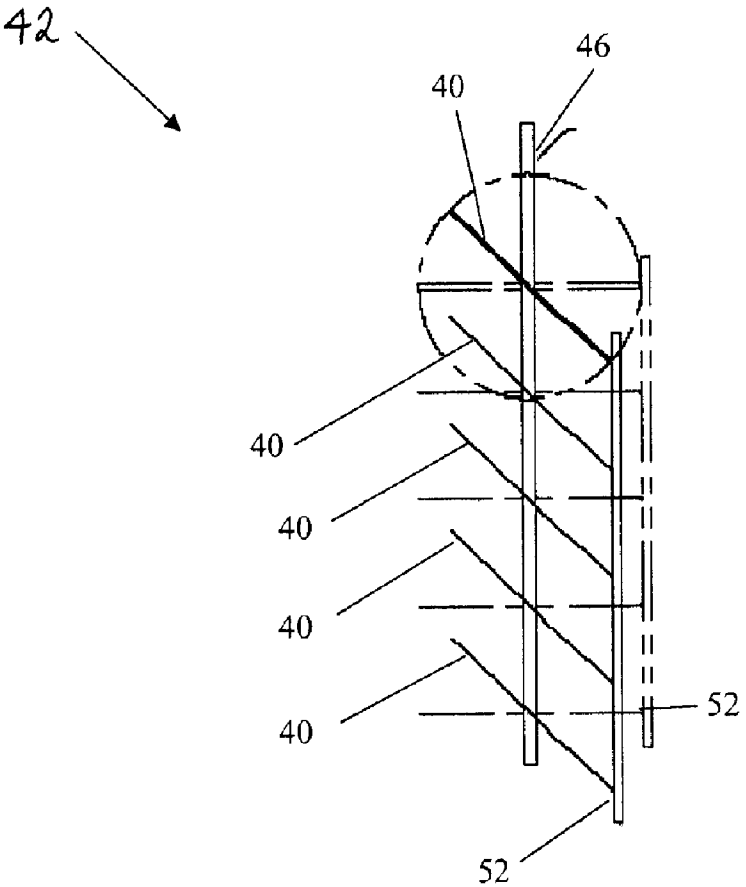
FIG. 8A is a somewhat schematic side elevation view of a preferred light baffle showing the adjustability of the slats.

As shown in FIGS. 8A and 8B, each slat 40, and thus at least the light baffles 42, may be configured to, for example, be supported for pivotal movement on a louver frame 46 on respective opposed trunnions or axles 50. By moving a louver link 52 to one extreme, the slats 40 are in a fully opened position, as depicted in FIG. 8A (dashed lines). Similarly, as the louver link 52 is moved away from that extreme position, the slats 40 may be positioned in an array of partially opened positions. FIG. 8A depicts one of those partially opened positions (solid lines). Moreover, the louver link 52 may be moved in such a manner as to close the slats 40 and thus prevent any light from transmission through the baffle 42. There are several methods of controlling the movement of the louver link 52. Preferably, the louver link 52 is controlled to move with respect to frame 46 by way of a louver drive/motor 48 connected to one of the slats at one of its axles 50. The drive axle 50 adjusts each slat 40. The drive/motor 48 may be remotely controlled by, for example, radio-controlled mechanisms or by hardwiring controls to the lighting pole's 20 ground-accessible service box (not depicted). It should be understood by those skilled in the art that there are a number of other methods that may be employed to accomplish securing the slats 40 to form the light baffles 42 or 42*a*, in lieu of louver link 52.

While slat position is important, each slat 40 may be treated to effectuate maximum lighting specifications. For example, the surface of each slat 40 may be treated to reduce glare from the lamps 32 or, conversely provide maximum lighting to the subject lighting area. For example, the surfaces of the slats 40, may be anodized a flat black to lower reflectivity and reduce the glare from the lanterns 32. In other situations, such as in stadium lighting, it may be advantageous to reflect more light from the fixtures (26, 28). Accordingly, in stadium lighting applications and the like, the slats 40 may be highly polished, perhaps even given a mirrored finish. Thus, the highly polished slats 40 reflect more or all of the light to the subject lighting area while minimizing light spillage to surrounding areas outlying the stadium. It should be understood by those skilled in the art, one or selective surfaces of certain slats 40 or all surfaces of the slats may be treated to achieve a desired effect. It should also be understood that slats 40 may undergo other surface treatments not described herein.

Figure 9:
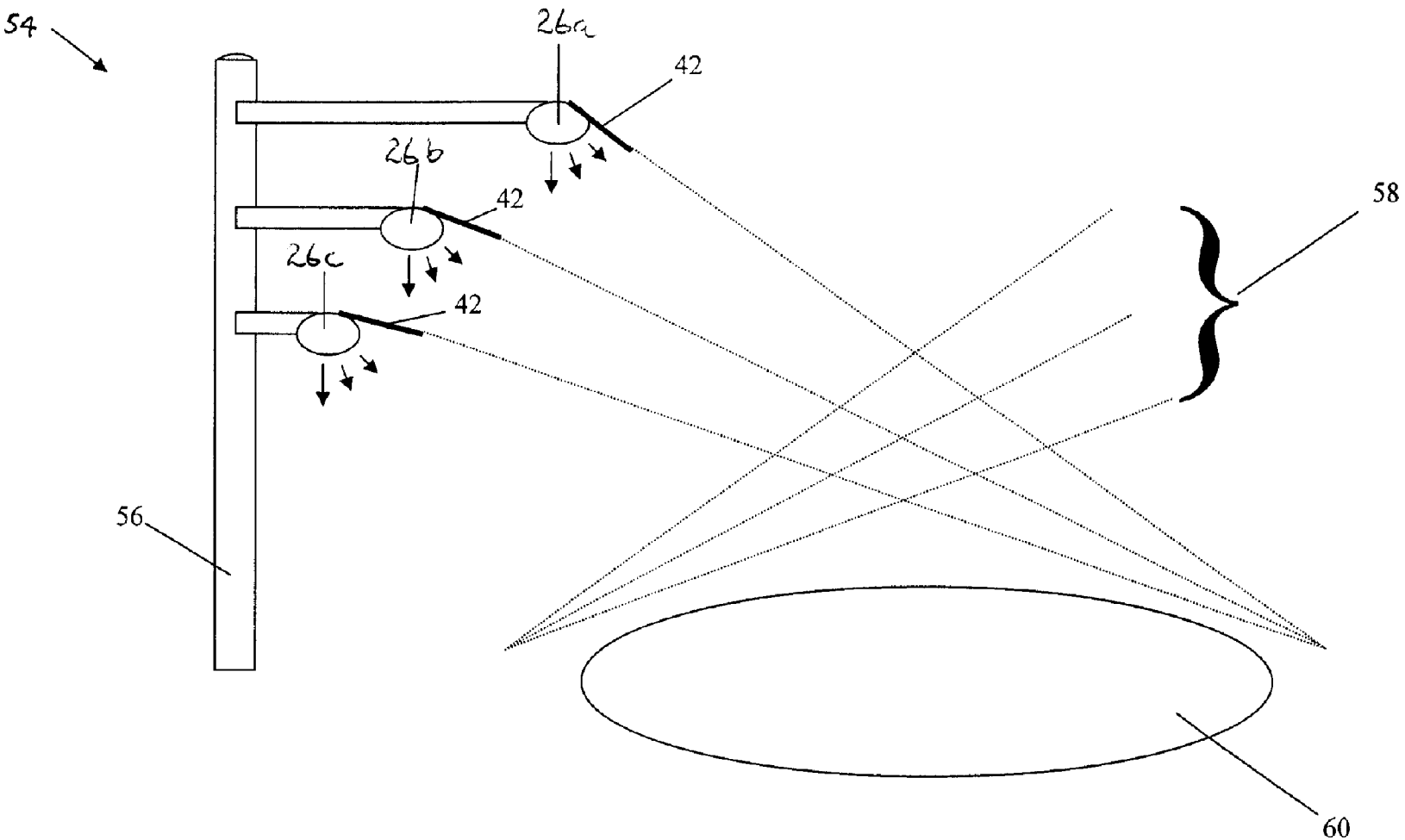
FIG. 9 is a schematic diagram showing stadium lighting capabilities of a preferred embodiment of the invention.

As an example of lighting applications other than highway lighting applications, FIG. 9 depicts a simplified version of a sports stadium lighting system 54 attached to a pole 56 and configured for three rows 26*a*, 26*b* and 26*c* of light fixtures. Each row 26*a*, 26*b* and 26*c* of light fixtures preferably has an adjustable light baffle 42 associated with it. It should be understood that the sports lighting system 54 may include, for example, other light systems maintained at various other areas of the stadium 60.

A preferred embodiment thus provides a versatile large area lighting system 18 in which the orientation and physical properties of the slats 40 control the amount and intensity of the light passing between the lamps 32 and to the subject lighting area. In addition, the large area lighting system 18 controls the amount and intensity of the light passing to any area adjacent to the subject lighting area, thus minimizing any indirect light spillage and reducing light pollution and sky glow while adding only a minimal amount of EPA to the lighting system 18. In addition, a preferred embodiment advantageously is maintenance free and is readily adaptable to meet the lighting design specifications of virtually any application.

Although preferred embodiments of large area lighting systems have been described in detail herein, it will be appreciated that while the description has principally referenced a system for use with a typical large area lighting system, it is to be understood that systems 18 and 54 may be utilized for other large area lighting employing simple industrial and street lighting columns, high mast lighting systems, hydraulic-based hinged columns and poles with top or bottom latching lifting mechanisms.

The specific embodiments discussed herein are merely illustrative of specific ways to make and use the invention, and do not delimit the scope of the invention. For example, the description has principally referenced large area lighting system 18 used in conjunction with highways, however it should be understood that a preferred embodiment may be used in a variety of other large area applications such as those employed in stadiums, power plants, airports, shopping centers, parks, railroad yards, coal mines, commercial parking lots, ports and the like. Those skilled in the art will recognize that various substitutions and modifications may be made to the invention without departing from the scope and spirit of the appended claims.

What is claimed is:

1. A large area outdoor lighting system adapted for support on a high mast support pole, said lighting system comprising:

a lighting system frame comprising an elongated, horizontally extending rack assembly supporting plural spaced apart light fixtures, said light fixtures projecting light generally downwardly;

bracket means interconnecting said frame with said support pole;

a first set of plural elongated, generally horizontally extending, spaced apart slats forming light baffles for said light fixtures to prevent projection of light in at least one direction with respect to said lighting system, said slats of said first set being fixed spaced apart relative to each other and generally horizontally extending to form elongated slots therebetween to minimize wind resistance of said slats of said first set while shielding an area from light transmission, said slats of said first set being supported on spaced apart, generally vertically depending rods connected at an upper end thereof, respectively, to said rack assembly, said slats of said first set being secured spaced from each other by plural spacers disposed on said rods and between respective ones of said slats of said first set to provide said slots;

an elongated rack member secured to said rods at spaced apart points with said slats of said first set disposed between said rack member and said rack assembly;

spaced apart braces connected to said rack member and to said rack assembly for reinforcing said slats of said first set in a working position thereof wherein said braces comprise plural brace members interconnected to each other and to said rack assembly and said rack member, respectively, and adjustable for adjusting an overall height of a set of said slats for selectively varying said area which is shielded from light transmission; and a second set of slats supported on said rack assembly spaced from said first set of slats and on an opposite side of said light fixtures from said first set of slats, said second set of slats including plural spaced apart slats connected to plural spaced apart vertically depending rods and forming a second light baffle for blocking transmission of light from said light fixtures in another direction.

2. The lighting system set forth in claim 1 wherein:

said rods supporting said second set of slats are connected to a rack member spaced from said rack assembly, and connected to a brace member.

3. The lighting system set forth in claim 1 wherein:

surfaces of said slats are non-reflective.

4. The lighting system set forth in claim 1 wherein:

surfaces of said slats have a mirror finish.

5. A large area outdoor lighting system supported on a high mast support pole, said lighting system comprising:

a lighting system frame comprising an elongated, horizontally extending rack assembly supporting plural spaced apart light fixtures, said light fixtures projecting light generally downwardly;

bracket means interconnecting said frame with said support pole;

a first set of plural elongated, generally horizontally extending, spaced apart slats forming light baffles for said light fixtures to prevent projection of light in at least one direction with respect to said lighting system, said slats of said first set being fixed spaced apart relative to each other and generally horizontally extending to form elongated slots therebetween to minimize wind resistance of said slats of said first set while shielding an area from light transmission, said slats of said first set being supported on spaced apart, generally vertically depending rods connected at an upper end thereof, respectively, to said rack assembly, said slats of said first set being secured spaced from each other by plural spacers disposed on said rods and between respective ones of said slats of said first set to provide said slots;

an elongated rack member secured to said rods at spaced apart points with said slats of said first set disposed between said rack member and said rack assembly;

a second set of slats supported on said rack assembly spaced from said first set of slats and on an opposite side of said light fixtures from said first set of slats, said second set of slats including plural spaced apart slats connected to plural spaced apart vertically depending rods and forming a second light baffle for blocking transmission of light from said light fixtures in another direction;

said rods supporting said second set of slats are connected to a rack member spaced from said rack assembly; and spaced apart braces connected to said rack members and to said rack assembly for reinforcing said slats of said first set and said second set in a working position thereof, respectively.

6. The lighting system set forth in claim 5 including:

a second rack assembly spaced from said first rack assembly on an opposite side of said support pole and supporting plural spaced apart light fixtures and a set of elongated vertically spaced apart generally horizontally extending slats forming slots therebetween and shielding light transmission from said lighting system in a predetermined direction.

7. A large area outdoor lighting system adapted for support on a high mast support pole, said lighting system comprising:

a lighting system frame comprising a first elongated, horizontally extending rack assembly supporting plural spaced apart light fixtures, said light fixtures projecting light generally downwardly;

bracket means interconnecting said frame with said support pole;

a first set of plural elongated, generally horizontally extending, spaced apart slats forming light baffles for said light fixtures to prevent projection of light in at least one direction with respect to said lighting system, said slats of said first set being fixed spaced apart relative to each other and generally horizontally extending to form elongated slots therebetween to minimize wind resistance of said slats of said first set while shielding an area from light transmission, said slats of said first set being supported on spaced apart, generally vertically depending rods connected at an upper end thereof, respectively, to said first rack assembly, said slats of said first set being secured spaced from each other by plural spacers disposed on said rods and between respective ones of said slats of said first set to provide said slots;

a first elongated rack member secured to said rods at spaced apart points with said slats of said first set disposed between said first rack member and said first rack assembly;

spaced apart braces connected to said first rack member and to said first rack assembly for reinforcing said slats of said first set in a working position thereof a second elongated horizontally extending rack assembly supporting plural spaced apart light fixtures, said light fixtures on said second rack assembly projecting light generally downwardly;

said second rack assembly being connected by bracket means to said support pole;

a second set of plural, elongated generally horizontally extending, spaced apart slats forming light baffles for said light fixture supported by said second rack assembly to prevent projection of light in a predetermined direction with respect to said lighting system, said slats of said second set being fixed spaced apart relative to each other and generally horizontally extending to form elongated slots therebetween to minimize wind resistance of said slats of said second set while shielding an area from light transmission, said slats of said second set being supported on spaced apart, generally vertically depending rods connected at an upper end thereof, respectively, to said second rack assembly, said slats of said second set being secured spaced from each other by plural spacers disposed on said rods supporting said slats of said second set and between respective ones of said slats of said second set to provide slots between said slats of said second set;

a second elongated rack member secured to said rods supporting said second set of slats at spaced apart points with said slats of said second set disposed between said second rack member and said second rack assembly; and spaced apart braces connected to said second rack member and to said second rack assembly for reinforcing said slats of said second set in a working position thereof.

8. A large area outdoor lighting system adapted for support on a high mast support pole, said lighting system comprising:

a lighting system frame comprising an elongated, horizontally extending rack assembly supporting plural spaced apart light fixtures, said light fixtures projecting light generally downwardly;

bracket means interconnecting said frame with said support pole;

a first set of plural elongated, generally horizontally extending, spaced apart slats forming light baffles for said light fixtures to prevent projection of light in at least one direction with respect to said lighting system, said slats of said first set being fixed spaced apart relative to each other and generally horizontally extending to form elongated slots therebetween to minimize wind resistance of said slats of said first set while shielding an area from light transmission, said slats of said first set being supported on spaced apart, generally vertically depending rods connected at an upper end thereof, respectively, to said rack assembly, said slats of said first set being secured spaced from each other by plural spacers disposed on said rods and between respective ones of said slats of said first set to provide said slots;

an elongated rack member secured to said rods at spaced apart points with said slats of said first set disposed between said rack member and said rack assembly;

spaced apart braces connected to said rack member and to said rack assembly for reinforcing said slats of said first set in a working position thereof and a second rack assembly spaced from said first rack assembly and on an opposite side of said support pole and supporting plural spaced apart light fixtures and a set of elongated vertically spaced apart generally horizontally extending slats for shielding light in a predetermined direction with respect to said lighting system.

* * * * *